United States Patent [19]

Vieille-Mecet

[11] 4,203,411

[45] May 20, 1980

[54] ADDITIONAL CARBURETOR

[76] Inventor: Jean-Pierre J. Y. Vieille-Mecet, 57, rue du President Coty, Ambares (Gironde), France

[21] Appl. No.: 869,293

[22] Filed: Jan. 13, 1978

Related U.S. Application Data

[63] Continuation of Ser. No. 633,016, Nov. 17, 1975, abandoned.

[30] Foreign Application Priority Data

Nov. 18, 1974 [FR] France ..... 74 37967

[51] Int. Cl.[2] ..... F02M 31/00

[52] U.S. Cl. ..... 123/127; 123/139 AW; 261/69 R

[58] Field of Search ..... 123/127, 139 AW; 261/69 R

[56] References Cited

U.S. PATENT DOCUMENTS

| | | | |
|---|---|---|---|
| 1,615,512 | 1/1927 | Harkin | 123/127 |
| 2,092,685 | 9/1937 | Viel | 123/127 |
| 3,618,579 | 11/1971 | Varran | 123/127 |

*Primary Examiner*—Douglas Hart

*Attorney, Agent, or Firm*—Mason, Fenwick & Lawrence

[57] ABSTRACT

The invention concerns an additional carburetor characterized in that it consists of a body fitted on the intake pipe, a carburation adjusting head directly fed with fuel under pressure, an intake pressure element arranged downstream the throttle of the main carburetor, said intake pressure element operating opening of the float-spindle of the carburetor, arranged inside the carburation adjusting head when depression in the intake pipe becomes lower than a preadjusted sought value, and providing the intake pipe with additional fuel.

3 Claims, 4 Drawing Figures

ADDITIONAL CARBURETOR

This is a continuation of application Ser. No. 633,016, filed Nov. 17, 1975 and now abandoned.

The present invention relates to an additional carburetor which makes it possible to reduce fuel consumption of engines equipped therewith, when fitted downstream the main carburetor thereof.

More particularly, said additional carburetor is fitted on the intake pipe, downstream the main carburetor; the main jet of the later is previously replaced by a jet having a smaller diameter. The additional carburetor is set into work when the working conditions of the engine exceeds a predetermined threshold depending on the diameter of the jet which replaces the main one.

Carburetors fitted at present on motor vehicles generally comprise two jets, one of them called "pilot jet", intended to ensure working of the engine at very low working speed, the other called "main jet" intended to ensure working of the engine from the low working speed to the maximal working speed. Generally, the main jet is arranged on a lower level with that of the fuel inside the float-chamber of the carburetor, and limits only partly delivery of the fuel, its size being provided for making the mixture sufficiently rich at the maximal working speed: the mixture thus made is then too rich at low working speeds for being suitably proportioned at the high working speed of the engine. Such an arrangement has the drawback to result in an excessive consumption of fuel when the engine is working at low speeds and generates a great pollution. There is a possibility to remedy these drawbacks which consists in reducing the diameter of the main jet of the carburetor, which makes it possible to get a mixture suitably proportioned at low working speeds, but which is too poor when the engine is working at high speeds; such an arrangement, although resulting in a fuel-saving does not then solve the problems of the high working speeds of the engine which can no longer be reached.

The purpose of the present invention is to remedy the drawbacks of the known devices and provides an additional carburetor arranged on the intake pipe downstream the main carburetor and which is set working when the power required to the engine exceeds a certain value, the main jet of the carburetor, the diameter of which has previously been reduced, ensuring a suitable feeding at low working speeds.

To this end, the invention provides an additional carburetor characterized in that it consists of a body fitted on the intake pipe, a carburation adjusting head directly fed with fuel under pressure, an intake pressure element arranged downstream the throttle of the main carburetor, said intake pressure element operating opening of the float-spindle of the carburetor, arranged inside the carburation adjusting head when depression in the intake pipe becomes lower than a preadjusted sought value, and providing the intake pipe with additional fuel.

Thus, said additional carburetor works only when the working speed of the engine exceeds a certain threshold, feeding below such a threshold being performed by the main carburetor carrying a jet with a small diameter, and feeding beyond said threshold being simultaneously performed by the main carburetor and the additional one. The additional carburetor is fully automatically operated and, so that it is instantaneous, its working is subjected to a pressure intake arranged downstream the main carburetor; when the working speed of the engine reaches the predetermined threshold, the depression inside the intake pipe becomes lower than the preadjusted value sought and the intake pressure element operates starting of the additional carburetor, such an arrangement showing the advantage of initiating no working inertia, both on a level with the start of the additional carburetor and that of the stop thereof.

According to a further characteristic, the body of the additional carburetor is fitted lateral on a collar arranged on the intake pipe and holds the pressure intake element the carburation adjusting head being arranged at one end of the body.

Thus, existing engines can easily be transformed by setting the collar on to the intake pipe thereof; furthermore, such an arrangement makes it possible to use only one additional carburetor which can be fitted on any types of engines.

According to a further characteristic, the carburation adjusting head of the combustion nozzle of the additional carburetor carries the fuel under pressure and makes possible the adjustment of the flow of the gasoline as desired.

Thus, whatever the type of engine, it is possible to adapt the same additional carburetor with the intake flow of the fuel being adjusted by means of the combustion nozzle. Furthermore, such an arrangement makes possible the modification of the working speed from the threshold at which the additional carburetor is set to work by merely changing the main jet of the main carburetor and an additional adjustment performed on the combustion nozzle of the additional carburetor.

The present invention will be described with more details by means of the mode of embodiment shown in the attached Drawings, wherein.

It is to be noted that the same subjects bear the same references in the above Figures.

Figure 1:
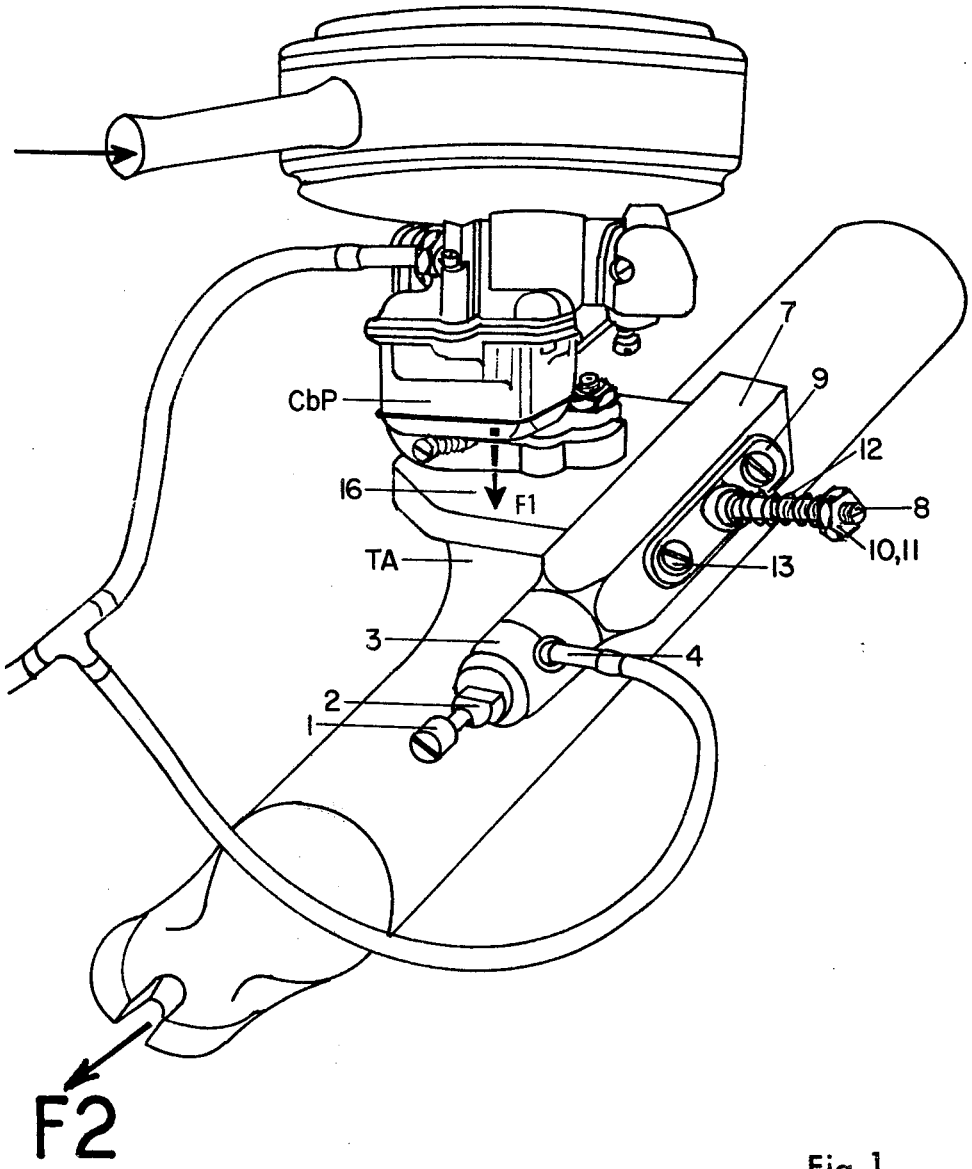
FIG. 1 is a perspective view of the whole of the additional carburetor arrenged on the intake pipe, downstream the main carburetor.

FIG. 1 shows the additional carburetor fitted on to the intake pipe TA, downstream the main carburetor CbP. The mixture coming from the main carburetor is delivered according to arrow F1; the arrow F2 refers to the richer mixture leaving the additional carburetor when the latter is working.

Figure 2:
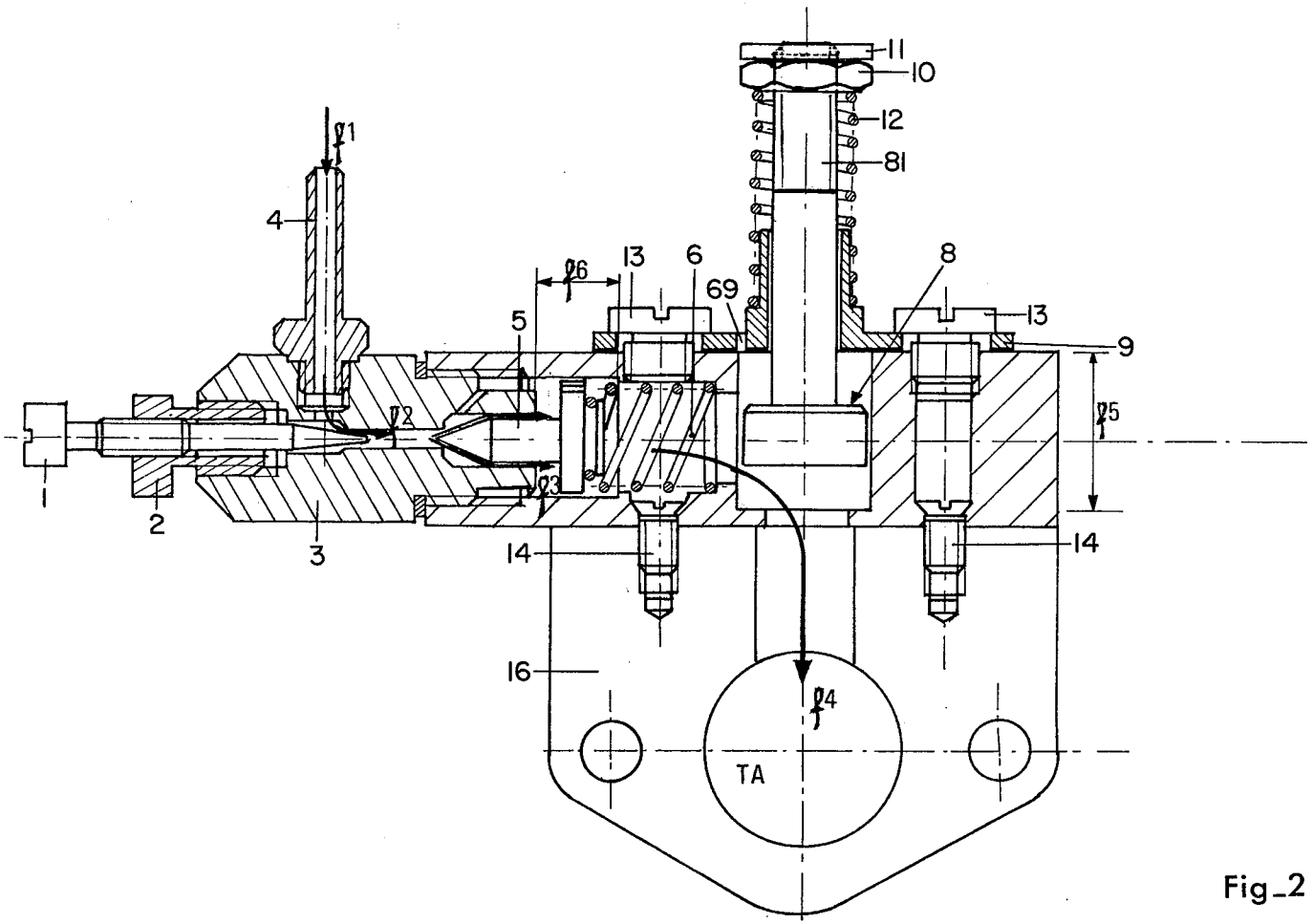
FIG. 2 is a cross-section view of the additional carburetor.

The additional carburetor carries a fixing collar 16, arranged on to the intake pipe TA, such as achieved on the engines known at the moment. The body 7 of the carburetor is fitted on to the collar 16 by means of screws 14 (see the cross-section view in FIG. 2). The body 7 holds, on the one hand, a pressure intake element consisting of a piston 8 moving inside a cylindrical chamber CP, arranged transversely in the body 7; traveling of said piston 8 is controlled by the guide-rod 9 fitted to the body 7 opposite the collar 16 by means of screws 13. The rod 81 of the piston 8 slides freely inside the guide 9. Adjustment of the motion of the piston 8 is ensured by means of a spiral spring 12 fitted on to the rod 81 and resting, on the one hand, on the plane portion of the guide 9 and, on the other, on the head of the piston consisting of a bolt 10; adjustment of the effort of the return-spring 12 is performed by more or less screwing said bolt 10 on the rod 81. So as to prevent the device from being put out of order, a counter-bolt 11 keeps the bolt 10 constituting the head of the piston steady.

At one of the longitudinal ends of the body (7), threads are provided to permit securing of the adjusting head (3). The adjusting head is directly fed by the fuel pump of the engine, with the feeding duct being connected to the inlet fitting (4), positioned at the end of the adjusting head (3). The combustion nozzle fitted inside the adjusting head creates an orifice corresponding to the predetermined fuel flow of the additional carburetor which depends on the reduction achieved on a level with the main jet of the main carburetor. The advantage of the combustion nozzle (2) of the present invention in relation to the former adjusting process is fool-proof operation and accurate proportioning of the gasoline flow in the additional carburetor.

Figure 3A:
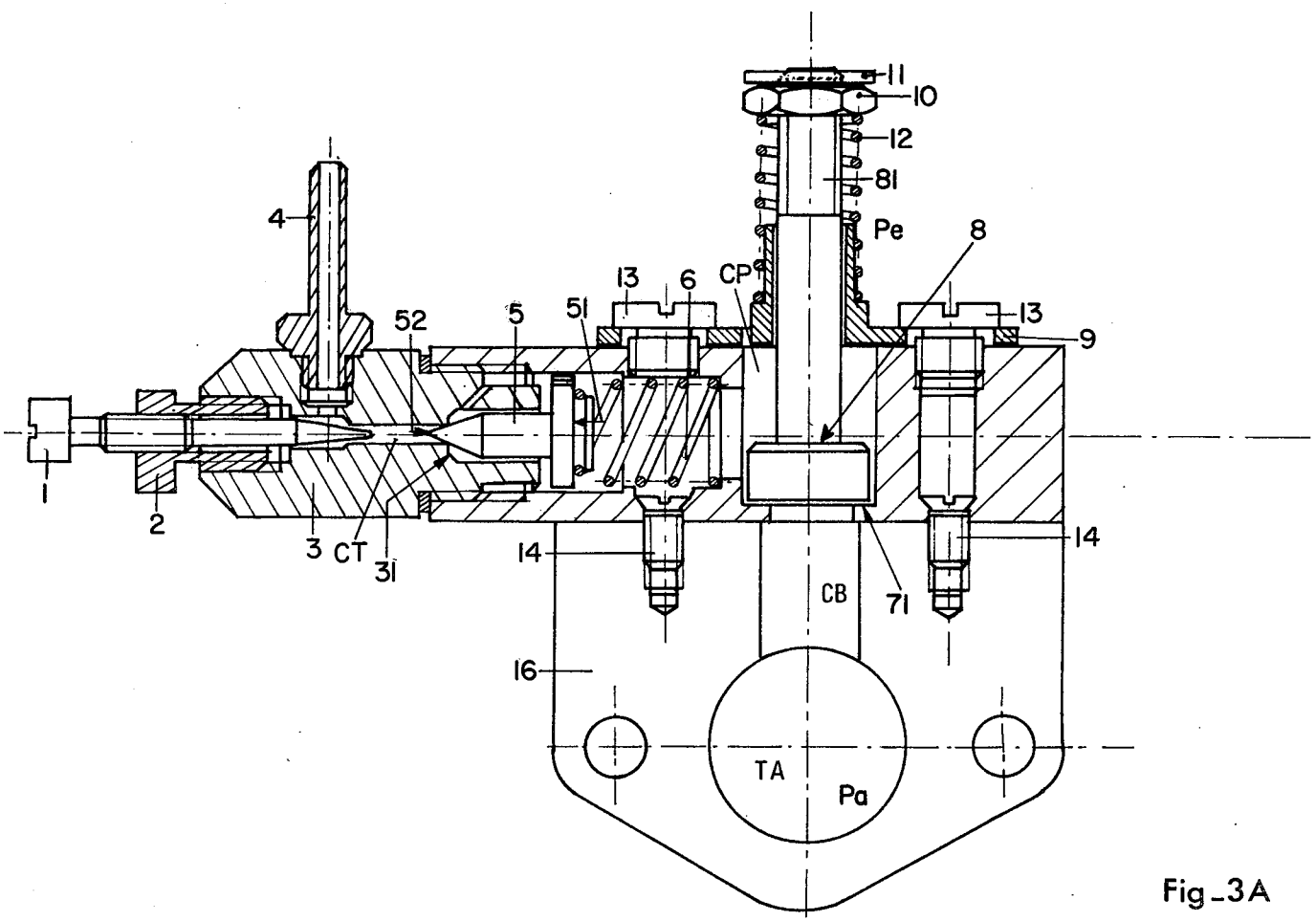
FIGS. 3A and 3B show the way in which said additional carburetor is working.

FIG. 3A shows said carburetor when stopped: in such a position, the piston 8 is in contact with the the collar 71 of the body 7, the effort exerted by the difference in pressure Pé-Pa (Pé=the external pressure or in this instance the pressure of the chamber of the piston CP, the guide-head ensuring no tightness between the external and internal portions of the chamber CP, Pa=-the intake pressure inside the intake pipe TA) exerting on the head of the piston an effort greater than that exerted by the return-spring 12. The pressure Pé, inside the chamber CP, is also applied on to the head 51 of the float-spindle 5, and initiates a force which, added to the compression effort of the spring 6, is greater than the force initiated by the fuel on the surface 52 of the float-spindle, which ensures closing by applying the float-spindle 5 on to the seat 31 formed on the combustion adjustment head 3. Of course, the spring 6 must be adjusted in such a way that when the pressure Pé does no longer exert on the head 51, the pressure exerted by the fuel on the surface 51 of the float-spindle 52 makes the later open.

Figure 3B:
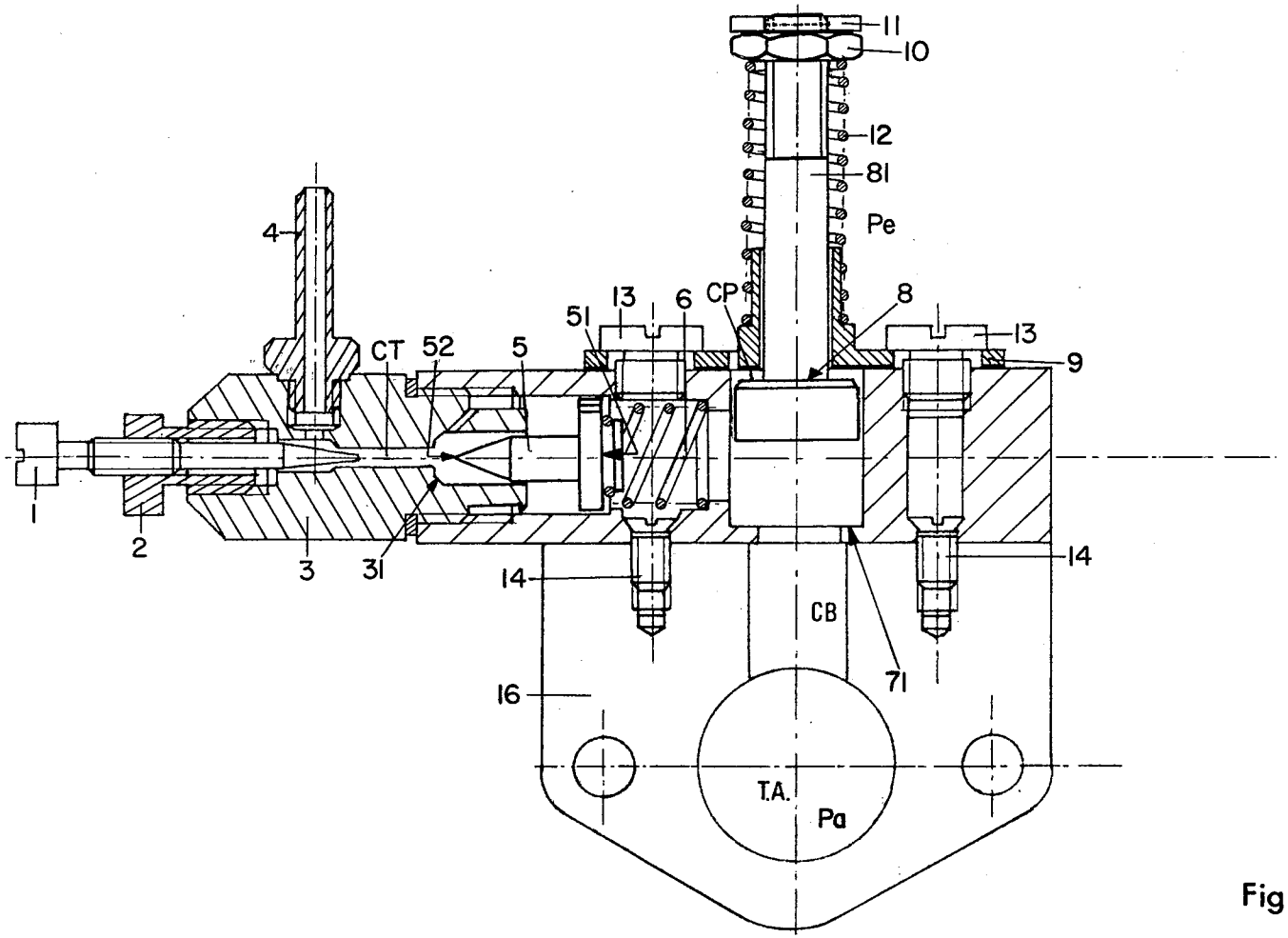

FIG. 3B is a view of the additional carburetor in a working position: when the intake pressure Pa is greater than the sought value, the difference Pé-Pa becomes insufficient to overcome the return effort exerted by the spring 12 on the head 10 of the piston. Then, the spring 12 ensures opening of the duct CB and puts the cylindrical chamber CP of the piston into communication with the intake pipe TA (such as shown at 3B). Then the pressure Pa exerts on the head 51 of the float-spindle 5, and as said pressure is lower than Pé, the push thus exerted by both said pressure and the spring 6 becomes insufficient for overcoming the pressure exterted by the fuel on the conical head 52 of the float-spindle: consequently, the later opens and the fuel located in the chamber CT of the carburation adjusting head flows towards the cylindrical chamber CP of the piston, then inside the intake pipe TA through the channel CB provided in the collar. The mixture coming from the main carburetor and traveling inside the intake pipe TA is then kept richer thanks to this fresh supply of fuel, said fresh supply being available till the pressure Pa decreases again and retakes a value such as Pé-Pa is likely to get the piston 8 back to its former position (FIG. 3A).

The additional carburetor then reacts depending on the vacuum available immediately downstream the main carburetor which decreases when the working conditions of the engine increase.

As a matter of fact, when the throttle of the main carburetor is closed or is but very little opened (that is to say that the engine is working at a very low speed, then only thanks to the main jet of the carburetor such as modified), the pressure downstream the carburetor, inside the intake pipe, is much more less than the external pressure, in view of the loses in charge which develop on a level with the throttle of the carburetor. When the working speed of the engine comes to or overpasses the working speed of the threshold in relation to which the main jet has been sized, the throttle of the carburetor is positioned in a greater opening thus causing a reduced vacuum (higher absolute pressure) in the intake pipe the pression inside said intake pipe is then getting close to the external pressure and $\Delta P = Pé - Pa$ reaches the sought value which ensures working of the additional carburetor, the effort developed on the head of the piston by $\Delta P$ becoming lower than the return effort of the spring; opening of the float-spindle is then performed and additional fuel is brought to the mixture of the main carburetor.

The auxiliary carburetor of the present invention is triggered into operation when the manifold vacuum Pa decreases to a reduced level (higher absolute pressure but less than atmospheric pressure) so that the force created by the reduced pressure differential across the piston 8 is insufficient to overcome the force of spring 12. It should be noted that atmospheric pressure acts through ports 69 on the rod side of piston 8. The clearance about the piston in the chamber CP is exaggerated in the drawing and it should be understood that the pressure on the rod side of the piston 8 always exceeds the pressure on the other side of the piston. Movement of piston 8 to the position of FIG. 3B permits the manifold vacuum to move spindle 5 to the open position to permit the flow of fuel from the auxiliary carburetor into the engine. Conversely, when the pressure Pa in the manifold increases, such as occurs when the throttle is moved toward its closed position, atmospheric pressure on the end of rod 81 and on the rod side of the piston 8 acting through port 69, quickly snaps the piston back to the position of FIG. 3A. It should be observed that when the piston 8 is in the intermediate position of FIG. 2, the pressure on the rod side of the piston is always greater than the pressure on the other side of the piston due to the vacuum pressure Pa since the port 69 is of inadequate size to permit these pressures to equalize.

Of course, the invention is not limited to the example of embodiment described and depicted hereabove, from which other modes and forms of embodiments can be provided without thereby departing from the scope of the invention.

What I claim is:

1. A carburetor system for reducing fuel consumption in internal combustion engines comprising a main carburetor mounted on an intake passageway and having a running jet sized to supply an adequate flow of fuel to the intake passageway for a predetermined level of power, a body mounted on said intake passageway downstream of said main carburetor and having an inlet passageway for receiving fuel under pressure, valving means for opening or closing the inlet passageway, pressure intake means communicating with the intake passageway downstream of the main carburetor for opening said inlet passageway to the intake passageway when the pressure in the intake passageway downstream of the main carburetor is above a predetermined pressure and closing the inlet passageway when the pressure is lower than said predetermined pressure and means for opening the valving means to provide additional fuel to the engine in response to opening of said inlet passageway to the intake passageway by said pressure intake means.

2. The carburetor system of claim 1 wherein said pressure intake means comprises a first valve seat in said inlet passageway intermediate said valving means and said intake passageway, a piston engageable with said first valve seat, first biasing means for applying a biasing force to the piston to urge the piston toward the first valve seat in a direction toward the intake passageway, said biasing force being of such a level as to permit movement of the piston away from the first valve seat when the pressure in the intake passageway is higher than said predetermined pressure, said valving means including a second valve seat in said inlet passageway, a movable float spindle mounted between the first valve seat and the second valve seat engageable with said second valve seat to close the inlet passageway, second biasing means for urging the float spindle toward the second valve seat with a second biasing force in a direction away from the intake passageway to maintain the float spindle in contact with the second valve seat to close the inlet passageway when the pressure in the inlet passageway portion between the float spindle and the first valve seat is above said predetermined pressure but to permit movement of the movable float spindle away from the second valve seat when the pressure in said inlet passageway portion is less than said predetermined value.

3. The carburetor system of claim 2 additionally including restricting means in said inlet passageway comprising a needle valve extending into said inlet passageway in a location between the second valve seat and the source of fuel under pressure.

* * * * *